US011352197B2

(12) United States Patent
Sparschuh

(10) Patent No.: US 11,352,197 B2
(45) Date of Patent: Jun. 7, 2022

(54) GLASS ARTICLE LAYER, GLASS ARTICLE BUNDLE, AND PACKING METHOD

(71) Applicant: SCHOTT AG, Mainz (DE)

(72) Inventor: Georg Helmut Sparschuh, Vadodara Gujarat (IN)

(73) Assignee: SCHOTT AG, Mainz (DE)

( * ) Notice: Subject to any disclaimer, the term of this patent is extended or adjusted under 35 U.S.C. 154(b) by 92 days.

(21) Appl. No.: 16/715,872

(22) Filed: Dec. 16, 2019

(65) Prior Publication Data

US 2020/0189838 A1 Jun. 18, 2020

(30) Foreign Application Priority Data

Dec. 14, 2018 (DE) ..... 10 2018 221 782.3

(51) Int. Cl.

| | |
|---|---|
| ***B65D 85/42*** | (2006.01) |
| ***B65D 71/02*** | (2006.01) |
| ***B65D 85/20*** | (2006.01) |

(52) U.S. Cl.

CPC ..... *B65D 85/42* (2013.01); *B65D 71/02* (2013.01); *B65D 85/20* (2013.01)

(58) Field of Classification Search

CPC ..... B65D 85/42; B65D 71/02; B65D 85/20; F42B 39/08

USPC ..... 206/334, 336, 443, 446

See application file for complete search history.

(56) References Cited

U.S. PATENT DOCUMENTS

| | | | | |
|---|---|---|---|---|
| 2,350,752 | A * | 6/1944 | Graf | H01M 4/765 429/140 |
| 3,143,266 | A | 8/1964 | Imatake | |
| 3,294,225 | A | 12/1966 | Kenyon | |
| 3,373,540 | A | 3/1968 | Wisner | |
| 3,611,656 | A | 10/1971 | Chidsey | |
| 4,137,821 | A * | 2/1979 | Benedict | F42B 39/087 198/803.15 |
| 4,385,696 | A * | 5/1983 | Benedict | F42B 39/087 206/150 |
| 4,693,167 | A * | 9/1987 | Bagwell, Jr. | F42B 39/087 139/390 |
| 4,907,326 | A | 3/1990 | Dietzel | |
| 5,294,222 | A | 3/1994 | Smith | |

(Continued)

FOREIGN PATENT DOCUMENTS

| | | |
|---|---|---|
| DE | 82301 | 11/1970 |
| DE | 2729966 | 1/1979 |

(Continued)

OTHER PUBLICATIONS

ISO 6939.

DIN EN ISO 137, "Wool-Determination of fibre diameter—Projection microscope method", Sep. 2016, 19 pages.

*Primary Examiner* — Chun Hoi Cheung

(74) *Attorney, Agent, or Firm* — Ohlandt, Greeley, Ruggiero & Perle, L.L.P.

(57) ABSTRACT

A glass article layer is provided that includes at least two cylindrical glass articles extending in a z-direction and arranged side by side in an x-direction. Two spacers are provided spaced apart from one another at an interval longitudinally of the glass article in the z-direction. The spacers are arranged between the glass articles. The spacers are thread-like elements and at least one of the thread-like elements is provided at each spacer position.

22 Claims, 24 Drawing Sheets

(56) References Cited

U.S. PATENT DOCUMENTS

| | | | | |
|---|---|---|---|---|
| 6,915,619 | B2 | 7/2005 | Baldwin | |
| 2008/0156681 | A1* | 7/2008 | Albrecht | B65D 71/066 206/446 |
| 2012/0326442 | A1 | 12/2012 | Crichton | |
| 2016/0221736 | A1 | 8/2016 | Hayashi | |

FOREIGN PATENT DOCUMENTS

| | | |
|---|---|---|
| DE | 224555 | 7/1985 |
| DE | 4225876 | 10/2001 |
| DE | 20121582 | 2/2003 |
| EP | 0132587 | 2/1985 |
| JP | H09295686 | 11/1997 |
| WO | 2015037361 | 3/2015 |

* cited by examiner

GLASS ARTICLE LAYER, GLASS ARTICLE BUNDLE, AND PACKING METHOD

CROSS REFERENCE TO RELATED APPLICATIONS

This application claims benefit under 35 USC § 119 of German Application 10 2018 221 782.3 filed Dec. 14, 2018, the entire contents of which are incorporated herein by reference.

BACKGROUND

1. Field of the Invention

The invention relates to a glass article layer. The invention also relates to a glass article bundle and to a packing method for producing a glass article layer.

2. Description of Related Art

When packing glass articles, in particular glass tubes, glass-to-glass contact of the outer surfaces occurs during the fabrication process. Initially, the glass tubes are arranged to form glass tube layers and then to form a glass tube bundle, which is held together in a rectangular shape by shrink caps at the ends thereof. The arrangement is made with the closest packing possible. When the surfaces of the tubes inevitably touch each other, linear contact (a contact line) is resulting. At the contact points along the contact line, surface damage or scratches may be caused.

When being palletized, these bundles are grouped in layers and stacked on a pallet. As the bundles are urged together, the outer end glass tubes will touch each other, which also implies the risk of surface damage and scratches.

It has been found that tube to tube relative movements cannot be completely ruled out with the previous packing techniques, especially under unfavorable shipping conditions such as poor roads, high seas for sea freight, turbulence for air freight. As a result, scratches are caused by frictional movement, which in the simplest case will cause cosmetic defects, but often make the tube unusable and will even lead to breakage of the tube in extreme cases.

In the first phase of glass-to-glass friction, small microcracks are created which significantly reduce the strength of the tube. If, as the friction continues, small glass particles are moreover released, unwanted sharp contact points are produced which will just come into contact with the already weakened surfaces of the tube and lead to breakage outcomes.

Another drawback is that freshly fabricated glass surfaces tend to stick together due to the chemically active surface (reaction with atmospheric moisture). Although this effect is reduced by the applied coating of the glasses, it cannot be completely avoided in practice. The sticking of the tubes may lead to microcracks in the surface during unpacking, which are critical insofar as they have a great stability-reducing effect.

Between the individual glass article layers, cardboard liners are arranged, for example, which may however cause marks on the glass tubes. Moreover, the cardboard usually does not separate the glass tubes within a glass tube layer. Once the assembly of layers is complete, the entire pallet is furthermore protected and held together by means of a shrink film. The weight of a pallet is around 800 kg on average.

During storage and shipping until delivery to the customer, the pallet is raised and lowered at least six to seven times. During this process, the tube surfaces of the tubes move against and relative to each other. During shipping to the customer, the movement of the transport means implies a high probability that the glass tube surfaces will frictionally engage on each other. The probability of surface damage of the glass tubes is very high in this case.

When the pallet is unstacked, the tube bundles are disassembled in the reverse order as in the packing, down to the individual glass tube, which is then fed into the processing machine, e.g. a vial forming machine, etc., either manually or by a robot. Here, again, the tube surfaces will inevitably come into contact thereby causing surface damage and scratches.

In order to minimize scratches on the glass tubes on their way to the customer, the glass tubes are often surface coated. However, the layer of several nanometers in thickness only provides protection as long as this layer is not scraped off by the mutual contact. Often, surface damage and scratches are resulting despite the coating. A surface coating is not able to prevent scratches, but at best minimizes them.

Surface defects cause several problems.

Scratches on the surface of the glass tubes caused by mutual contact during packing, in the package, on the pallet, during shipping, and when unstacking the pallet at the customer's site lead to a reduction of the visual quality or even non-compliance with the required specification.

Due to surface defects, the strength of the entire glass tube is significantly reduced, which then also applies to the pharmaceutical containers produced therefrom.

Surface damage may lead to breakage in the pallet and thus to a contamination of adjacent glass tubes or tube bundles. Scratches may entail misdetections in customer's optical online inspection equipment. Such scratches are even detected in the bottling systems and inspection systems of pharmacists, leading to corresponding complaints of the customers.

From DE 27 29 966, a package of tubes made of brittle material such as glass or glass ceramics is known, in which the tubes are provided in close-packing and in a rectangular assembly and are wrapped in a shrink film at least at the ends and end faces thereof so as to be fixed in their position. In the package, the tubes lie on top of each other and may scratch.

EP 0 132 587 A1 proposes to place a film or film strips on each layer of tubes in order to prevent the glass tube bundle from rolling apart. Instead of a film, the individual tubes can also be provided with an anti-slip coating, for example made of spray-on silicone, or with rings of polyethylene rubber or textile material fitted thereto.

DE 20 121 582 U1 discloses protective caps which are attached to both ends of a glass tube in order to prevent the tubes from coming into contact and causing scratches on the surface during packing and shipping. The protective caps serve both as spacers and for sealing the open tubes.

DE 42 25 876 C2 discloses a packing receptacle for rod-shaped items such as glass tubes and glass rods. A respective pair of strips made of a film-like material encloses juxtaposed glass tubes, thereby forming a multi-member belt that has receptacle members for accommodating a respective glass tube. The adjacent receptacle members are interlinked through a two-layered intermediate web. In the area of the intermediate webs, the two strips are bonded to one another by means of an adhesive and/or an embossing seam. Each glass tube layer has such a belt spaced apart from the ends of the glass tubes. Stacked glass tube layers contact each other in the region of the belts.

DD 224 555 A1 describes a method for packing glass tubes using shrink film, in which a respective prefabricated rectangular film sleeve made of plastic material is fitted onto each of the two ends of a glass tube package and these film sleeves are shrunk using appropriate shrinking units. Before fitting the prefabricated film sleeves, the glass tube ends can be completely or partially enclosed by further stabilizing means.

DD 82 301 discloses a package for shock-sensitive, tubular glass articles. Equally spaced trapezoidal flaps are punched into a pallet made of corrugated cardboard material in a manner so as to be arranged mutually offset in the opposite folding direction and folded up relative to the surface of the pallet to one side. The folded-up flaps form a lateral boundary for the articles to be packed and prevent lateral contact.

JP H09-295686 A discloses a spacer for a stacked assembly of glass tubes. The spacer has semicircular recesses which are separated by ribs and each one is adapted to accommodate one glass tube. In contrast to the prior art described in JP H09-295686 A, the glass tubes can be arranged with an offset by means of the spacer so that more glass tubes can be accommodated in the same total volume.

The spacer of JP H09-295686 A occupies much space between the tubes, so that consequently only a small number of glass tubes can be accommodated compared to the total volume of the stacked assembly. The same applies to some of the spacers known from WO 2015/037361 A1. Moreover, this type of spacer is complex to manufacture.

However, WO 2015/037361 A1 also discloses another option for a spacer. Accordingly, a band-shaped spacer made of paper or cardboard is placed between the glass tubes. The spacer then assumes a waveform. In this way, the spacing between the glass tubes is reduced, so that more glass tubes can be accommodated in the same volume.

SUMMARY

An object of the invention is to provide a glass article layer and a glass article bundle, in which surface damage and scratches on glass articles can be easily avoided from packing until delivery to the customer. Another object is to provide a method for producing such glass article layers.

This object is achieved with a glass article layer disclosed herein.

The glass article layer comprises at least two glass articles which extend in a z-direction and which are arranged side by side in an x-direction, wherein at least two spaced-apart spacer positions are provided in the z-direction longitudinally of the glass article, where spacers are arranged between the glass articles. The spacers are thread-like elements, and at least one thread-like element is provided at each spacer position.

Preferably, at least one common thread-like element is arranged between all the glass articles at each spacer position.

The term "glass" also refers to thermally treated glass, in particular glass ceramics.

The x- and z-directions mentioned refer to an orthogonal xyz-coordinate system which is shown in the figures for the sake of better understanding.

"Thread-like element" is preferably understood to mean a thin item twisted from fibers or from strips of material. In the context of the invention, the term "thread-like element" also encompasses strings, lines and cords. Preferably, the thread-like element is a round cord, an oval cord, a braided cord or a string from twisted film strips, for example. The thread-like element may be made of an extruded material.

The material of the spacer is preferably chosen so as to not cause any contamination of the glass surface by deposits or abrasion. At the same time, the material and shape of the spacers should also be chosen so that manufacturing is as cost-effective as possible.

Without the spacers, surface defects and scratches will be caused on the outer surfaces of the glass articles along the contact line of the glass articles that are arranged side by side in the z-direction. Such surface defects and scratches are avoided by the spacers.

"Between the glass articles" means that the spacers are arranged at least at the contact line of the glass article surfaces of adjacent glass articles.

The thread-like elements keep the glass articles of a glass article layer spaced apart. The thread tension has to be chosen such that the glass article layer, which may comprise up to 30 glass articles, is stabilized to such an extent that the glass article layer can be handled and stacked together with further glass article layers to form a glass article bundle.

A glass article bundle may have up to 30 glass article layers. The thread-like elements do not need to fulfil a holding or stabilizing function for the glass article bundle, since the necessary stability of the glass article bundle is preferably achieved by the cover sheaths provided at the ends of the glass article bundle, e.g. by applied caps that may consist of shrink film, for example.

The use of thread-like elements has the advantage that it is possible to dispense with prefabricated spacers which have to be arranged between the glass articles and/or glass article layers. A return transport of the prefabricated spacers from the customer to the manufacturer or disposal of the prefabricated spacers after unpacking of the glass article bundles is avoided.

Although the thread-like elements have to be disposed of or recycled as well, the thread volume to be disposed of is very low.

It has been found that breakage of or damage to the glass articles could be reliably ruled out despite the very small contact areas of the threads.

The load built-up over the respective glass article layer by further glass article layers within a glass article bundle is diverted exclusively at the support points of the thread-like elements.

Another advantage of the thread-like elements is that the production of glass article layers can be automated and that the unpacking of the glass article layers is simplified.

Preferably, the thread-like element is at least partially wrapped around at least one glass article, in particular around every glass article of the glass article layer.

"Wrapped around" is preferably understood to mean looped around the outer circumference of the glass article so that the thread-like element preferably moreover contacts the outer circumference of the glass article at least partially.

Preferably, two thread sections of the thread-like element are arranged at each spacer position between each pair of adjacent glass articles. The thread sections forming part of the one or more thread-like element(s) define the spacers. Two thread sections between each pair of adjacent glass articles have the advantage that under a load the force is distributed to two contact points in each case, which reduces the risk of breakage of the glass articles.

The glass articles are preferably glass tubes or glass rods.

The glass articles in the form of glass tubes and/or glass rods may be arranged in a glass article layer. In contrast to glass tubes, glass rods are made of solid material.

Preferably, the glass articles are cylindrical.

Preferably, the thread-like element has a thread thickness S, with 0.25 mm≤S≤2.5 mm, in particular with 1.5 mm≤S≤2.5 mm, preferably with 0.25 mm≤S≤1.25 mm, most preferably with 0.5 mm≤S≤1 mm. The thread-like element may in particular have a thread thickness S of at least 0.5 mm, or a thread thickness S of at least 4.0 mm.

For example, the thread-like element may have a thread thickness between not less than 0.25 mm and at least 2.5 mm, in particular from at least 1.5 mm to at most 2.5 mm, preferably from at least 0.25 mm to at most 1.25 mm, preferably at most 1.0 mm.

However, it is also possible for the thread thickness of the thread-like element to be 0.1 mm, or 0.2 mm, or 0.3 mm, or 0.4 mm, or 0.5 mm, or 0.6 mm, or 0.7 mm, or 0.8 mm, or 0.9 mm, or 1.05 mm, or 1.1 mm, or 1.5 mm.

The thread thickness of the thread-like element may be determined, for example, in accordance with or following the projection microscope technique as described in DIN EN ISO 137, for example.

The thread-like element is preferably made of a plastic material.

Preference is given to elastic polymer materials which enable the spacers to cushion vibrations of the glass articles occurring during shipping of glass article layers and glass articles bundles. The risk of breakage of the glass articles is thereby further reduced.

The plastic material preferably comprises polypropylene (PP), polyethylene (PE), preferably high-density polyethylene (HDPE), polyethylene wax, polyamide (PA), styrene-acrylonitrile copolymer (SAN), polyester, polyethylene terephthalate (PET), polybutylene terephthalate (PBT), polyurethane (PU), acrylonitrile-butadiene-styrene copolymer (ABS), polyether ether ketone (PEEK), and/or polycarbonate (PC), or the plastic material consists of the one or more polymer(s) mentioned.

In particular, the thread-like element may comprise polypropylene (PP), polyethylene, in particular high-density polyethylene (HDPE), polyethylene wax, polyamide (PA), styrene-acrylonitrile copolymer (SAN), polyester, polyethylene terephthalate (PET), polybutylene terephthalate (PBT), polyurethane (PU), acrylonitrile-butadiene-styrene copolymer (ABS), polyether ether ketone (PEEK), and/or polycarbonate (PC), or the thread-like element may be made of polypropylene (PP), polyethylene, in particular high-density polyethylene (HDPE), polyethylene wax, polyamide (PA), styrene-acrylonitrile copolymer (SAN), polyester, polyethylene terephthalate (PET), polybutylene terephthalate (PBT), polyurethane (PU), acrylonitrile-butadiene-styrene copolymer (ABS), polyether ether ketone (PEEK), and/or polycarbonate (PC).

The spacer positions are preferably arranged at intervals A in a range from 20 cm to 80 cm, in particular between 40 cm and 60 cm in the z-direction. The length of the glass articles is preferably from 1 to 4 m, in particular from 1 m to 2 m, so that preferably 4 to 10 spacer positions are provided and accordingly a corresponding number of thread-like elements is needed. The diameters of the glass articles are preferably in a range from 5 mm to 40 mm.

The spacer positions may in particular range between at least 20 cm and at most 90 cm.

Where reference is made to the diameter of a glass article such as a glass tube in the context of the present disclosure, this refers to the outer diameter of the glass article. The outer diameter may be between 6 mm and 50 mm, depending on the addressed end product.

By way of example, the outer diameter may be 6.85 mm, 8.15 mm, 10.85 mm, 14.45 mm, 17.05 mm, or 22.05 mm, in particular for a glass tube intended for a syringe body as the addressed final product, or may be 8.65 mm, 10.85 mm, 10.95 mm, 11.60 mm, 14.00 mm, 14.45 mm or 18.25 mm, in particular for so-called carpule tube, or may range between 6.8 mm and 8.9 mm, or between 9.0 mm and 14.9 mm, or between 15.0 mm and 17.9 mm, or between 18.0 mm and 19.9 mm, or between 20.0 mm and 24.9 mm, or between 25.0 and 30.9 mm, or between 31.0 mm and 34.9 mm, or between 35.0 mm and 42.9 mm, or between 43.0 mm and 50.0 mm, in particular for glass tube intended for vials as the addressed end products, or between 9.0 mm and 14.9 mm, or between 15.0 and 17.9 mm, or between 18.0 mm and 19.9 mm, or between 20.0 mm and 24.9 mm, in particular for glass tube intended for ampoules as the addressed end products.

In the context of the present disclosure, outer diameter is understood to be the maximum distance of two points on the outer surface of the glass article, for example of two points on the outer surface of a glass tube, in a cross-sectional view.

A glass article may in particular be provided with a round cross section. Here, a glass article is referred to as round within the scope of measurement accuracy, if its roundness error is not greater than a certain value. The roundness error here is a measure of the deviation of the glass article's cross sectional shape from the ideal shape of a circle, in particular in a direction perpendicular to the longitudinal extension of the glass article. The perimeter of each cross section of the test object, i.e. the glass article to be tested, has to lie between two concentric circles that are spaced by a distance t from each other and lie in the same plane. A glass article is therefore referred to as round if its roundness error has a value less than or equal to t. The roundness error results arithmetically from half the maximum difference of outer diameters in a measuring plane. In practice, the term ovality is often used, which is the difference between the maximum and minimum outer diameters in a measuring plane, i.e. the maximum difference of outer diameters. The ovality value is therefore twice the roundness error value.

Glass articles such as, for example, glass tubes have a fabrication-related curvature that may vary from manufacturer to manufacturer. Each manufacturer specifies a maximum value of the curvature for his products in his technical delivery conditions. The curvature is a product-specific parameter that is known for the respective product. For the glass tube lengths mentioned, the curvature is typically in the range from 0.5 mm to 1.5 mm. Taking into account this known parameter, the intervals and the thread thickness S should be chosen so that the glass articles will not contact each other, despite an existing curvature, when arranged side by side or when stacked on top of each other.

It is advantageous to take into account a safety margin in addition to the curvature.

The safety margin is intended to ensure that the cylindrical glass articles will not touch even if vibrations of the cylindrical glass articles should occur during shipping. The vibration behavior of the cylindrical glass article can be determined by vibration tests on the respective glass articles, for example, so that these findings can be considered when choosing the thread thickness S and the intervals A.

Generally, the greater the interval A is chosen, the greater the thread thickness S should be chosen.

An excessive thread thickness S, i.e. a thread thickness S>2.5 mm, will reduce the volume in a glass article layer or a glass article bundle comprising a multitude of glass articles, which is available for the glass articles of a glass article bundle.

According to a first embodiment, a one thread-like element is arranged at each spacer position. In this single-thread variant, only one thread-like element is required for all the glass articles of the glass article layer at each spacer position. This single-thread variant has the advantage that the glass article layers can be produced in a simple manner.

Preferably, the two thread sections are sections of one thread-like element. The two thread sections, which are arranged between each pair of adjacent glass articles at each spacer position are preferably sections of this single thread-like element.

Preferably, the two thread sections extend at an angle $\alpha$ relative to the z-axis, with $80° \leq \alpha \leq 100°$. Preferably, the angle $\alpha$ is equal to 90°. Since the thread sections are arranged at the contact line, the thread sections also extend at an angle $\alpha$ relative to the contact line.

Preferably, each thread section is wrapped around at least 5% of the outer circumference of a glass article, in particular around between 5% and 20% of the outer circumference.

The two thread sections are preferably arranged such that the one thread section extends over at least 5% of the outer circumference of one glass article and the other thread section over at least 5% of the outer circumference of the adjacent glass article. In this way it is ensured that even in case of slippage in the y-direction of the glass articles within a glass article layer, the thread section will always be effective as a spacer.

The two thread sections are preferably juxtaposed In the z-direction. The width B of the gap between the adjacent glass articles thus corresponds to the thread thickness S of the thread-like element.

Preferably, the thread-like element includes a loop in the y-direction below or above each glass article of the glass article layer. The loop is preferably provided between the two thread sections along the thread-like element and serves as an additional or exclusive spacer between the glass articles of adjacent glass article layers.

Preferably, the thread-like element is wrapped around at least 70% of the outer circumference of the glass article, in particular around at least 90% of the outer circumference of the glass article. Thus, the thread-like element, also engages on the lower side and/or the upper side of the outer surface of the glass article, as seen in the y-direction, and thus also serves as a spacer between the glass articles of glass article layers stacked on top of each other.

The two ends of the thread-like elements are preferably not connected to one another. The thread ends preferably hang down laterally from the glass article layer. The thread-like elements preferably have a length sufficient so that the ends of the thread-like elements hang down laterally from the glass article bundles. The ends of the thread-like elements can therefore be grasped easily for unpacking the glass article bundles and/or the glass article layer to separate the glass articles.

It has been found that once the glass article bundles have been completed, in particular once the cover sheaths have been attached at the ends of the bundles, the glass article bundles are stable enough so that there is no risk for the bundles to become disintegrated by pulling at the ends of the thread-like elements.

According to a second embodiment, a first thread-like element and a second thread-like element are provided at each spacer position.

In this embodiment, two thread-like elements are required per spacer position for all the glass articles of a glass article layer.

This two-thread variant has the advantage that a more stable glass article layer can be produced.

Preferably, one thread section is a section of the first thread-like element and one thread section is a section of the second thread-like element. The two thread-like sections which are disposed between each pair of adjacent glass articles at each spacer position thereby defining the spacers are thus sections of two thread-like elements. Preferably, each thread section engages on the outer circumference of both adjacent glass articles.

Preferably, the first thread-like element is wrapped around the upper half and the second thread-like element is wrapped around the lower half of the outer circumference of the glass article. The first thread-like element is the so-called upper thread, and the second thread-like element is the so-called lower thread.

Each of the two thread sections of the two thread-like elements preferably forms a bight. The bight of the second thread-like element is interlaced with the bight of the first thread-like element, and vice versa. The two thread sections preferably form an interlace between the adjacent glass articles, in particular at the contact line. By stretching the upper and lower threads relative to each other, the adjacent glass articles can be pulled together, so that a compact and stable glass article layer is achieved.

Preferably, the two thread sections between the adjacent glass articles, in particular at the contact line, form a knotted interlace. This knotted interlace brings about a further improvement in terms of stability. Accidental slipping of glass articles out of the wraps and thus slipping out of the glass article layer is effectively prevented.

Preferably, the two ends of the two thread-like elements are not connected to one another. The ends of the threads preferably hang down laterally from the glass article layer. The thread-like elements preferably have a sufficient length so that the ends of the thread-like elements hang down laterally from the glass article bundles. The ends of the thread-like elements can therefore be grasped easily for unpacking the glass article bundles and/or the glass article layer to separate the glass articles after the optionally provided cover sheath has been removed.

The glass article bundle according to the invention comprises at least two glass article layers according to the invention, which are arranged on top of each other in the y-direction, while the glass article layers are arranged offset one above the other. The glass articles are arranged in close-packing in the glass article bundle, which is not only space-saving, but also gives the glass article bundle enhanced stability.

The glass article bundle preferably comprises 5 to 30 glass article layers.

The thread-like elements of the glass article layers preferably also provide the spacers between the glass articles of adjacent glass article layers.

In particular the first embodiment of the glass article layer is advantageous because additional support points are provided by the loops provided above or below the glass articles, which better distribute the load within a glass article bundle. This further reduces the risk of breakage in the glass article bundle.

The glass article bundle preferably includes a cover sheath at least at the ends of the glass article body bundles. The ends of the glass article bundle coincide with the ends of the glass articles. In the case of glass tubes, the openings are preferably also covered by the cover sheath so that the interior of the glass tubes is not contaminated, for example during shipping. This cover sheath may for example be made of a shrink film.

The object is also achieved with a packing method.

The packing method for producing a glass article layer comprises the following steps in the following order:

(a) providing the glass articles;
(b) continuously feeding at least two glass articles and separating the glass articles in a separation station;
(c) continuously feeding the separated glass articles to a packing station that comprises at least two wrapping stations arranged at predetermined spacer positions;
(d) continuously feeding at least one thread-like element to each wrapping station;
(e) wrapping the thread-like elements around the glass articles at the predetermined spacer positions using a wrapping procedure;
(f) completing the wrapping procedure; and
(g) removing the glass article layer.

According to a first embodiment, step (e) comprises wrapping one thread-like element around the glass articles at each spacer position. This is a procedure for producing the single-thread variant.

Preferably, the wrapping procedure in step (e) comprises interposing two juxtaposed thread sections between the glass articles at each spacer position.

Preferably, a loop is placed at each spacer position above or below each glass article in step (e).

The wrapping method is comparable to the single-thread chain-stitch technique known from sewing machines for producing seams. The loop may therefore also be referred to as a chain loop.

According to a second embodiment, step (e) comprises wrapping a first thread-like element and a second thread-like element around the glass articles at each spacer position. This is a procedure for producing the two-thread variant.

Preferably, in step (e), the first thread-like element is wrapped around the upper half of the outer circumference of the glass article and the second thread-like element around the lower half thereof, and the two thread-like elements are mutually interlaced between the glass articles. This method works with the so-called upper thread and the so-called lower thread, whereby interlaces are formed.

This wrapping procedure is comparable to the lock-stitch technique known from sewing machines for producing seams.

According to a refinement of the method, the two thread-like elements may be additionally knotted between the glass articles. In this case, the wrapping procedure substantially corresponds to the knotted lock-stitch technique.

Preferably, the thread-like elements are severed between steps (f) and (g), in a step (f1), after having been wrapped around the last glass article of a glass article layer.

Once the glass article layers have been completed, the ends of the thread-like elements are preferably left to hang down freely, so that the glass articles can be easily unpacked without using tools such as knives or scissors.

If increased stability of the glass article layer is desired, the ends of the first thread-like element can be connected to the ends of the second thread-like element. The connection may be a knot, or the ends may be fused together especially if thread-like elements are made of a polymer. Gluing or connecting by means of a clip is possible as well.

The methods are preferably carried out such that at least two glass article layers, in particular a plurality of glass article layers are successively produced and packed continuously.

There is also the option to not sever the thread-like elements of a finished glass article layer, but rather to continue with the packing of the next glass article layer. Preferably, between steps (f) and (g), in a step (f2), the wrapping process for wrapping a further glass article layer is continued without previously severing the thread-like elements after the last glass article of a glass article layer has been wrapped.

In this case, the glass article layers remain interlinked and form a layer ribbon of glass article layers. In order to produce a glass article bundle, the glass article layers need not be transported individually and placed on top of each other, but may be placed continuously in a container, for example. For this purpose, the layer ribbon is folded alternately in the container, so that the glass article layers come to lie on top of each other.

In a further step, the glass article layers stacked on top of each other are provided with a cover sheath at their ends to form a glass article bundle.

The present disclosure therefore also relates to a glass article bundle comprising at least two glass article layers, in particular glass article layers according to embodiments of the present application and/or glass article layers that are produced or can be produced in a packing method according to embodiments of the present specification.

BRIEF DESCRIPTION OF THE DRAWINGS

Exemplary embodiments of the invention will now be explained with reference to the drawings, wherein.

DETAILED DESCRIPTION

Figure 1:
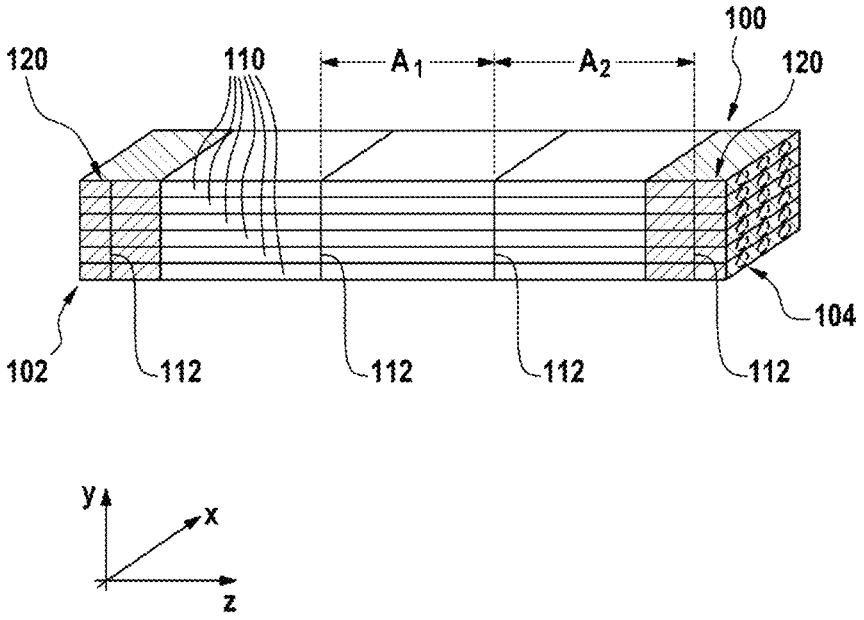
FIG. 1 is a perspective view of a glass article bundle comprising a plurality of glass article layers.

FIG. 1 shows a perspective view of a glass article bundle 100 which comprises six glass article layers 110. The glass article layers 110 lie in an x-z plane, and the glass articles 50 extend in the z-direction and are arranged side by side in the x-direction. The glass article layers 110 are stacked on top of each other in the y-direction.

Each glass article layer 110 has four spacer positions 112 arranged at an interval A from each other. In the embodiment shown here, two different intervals $A_1$ and $A_2$ are provided.

At each end 102, 104 of the glass article bundle 100, a cover sheath 120 is provided, which is made of a shrink film, which extends over an end portion of the glass article layer 110 and hence over end portions of the glass articles 50 and covers the end faces of the bundle 100 of glass articles. Since these are glass tubes in the embodiment shown here, the tube openings are also covered by the cover sheath 120, so that the interiors of the glass tubes are protected from contamination.

Figure 2:
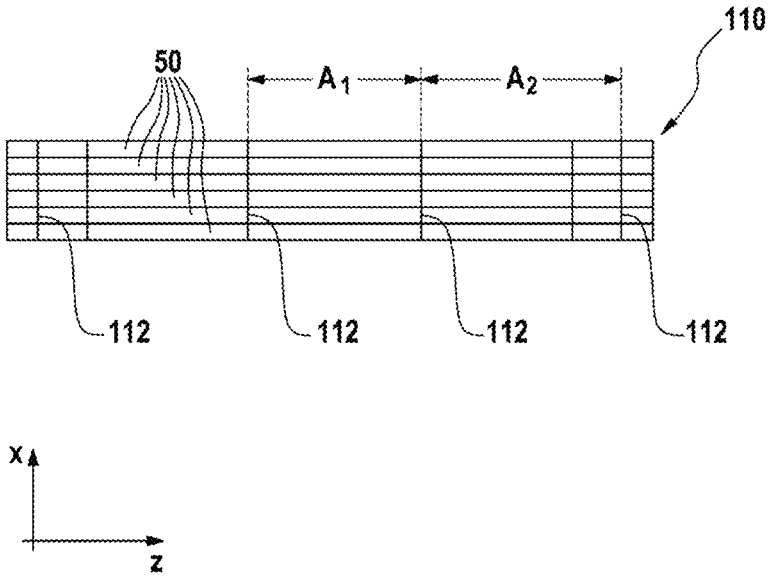
FIG. 2 is a plan view of a glass article layer.

FIG. 2 is a plan view of a glass article layer 110, which comprises six glass articles 50.

Figure 3:
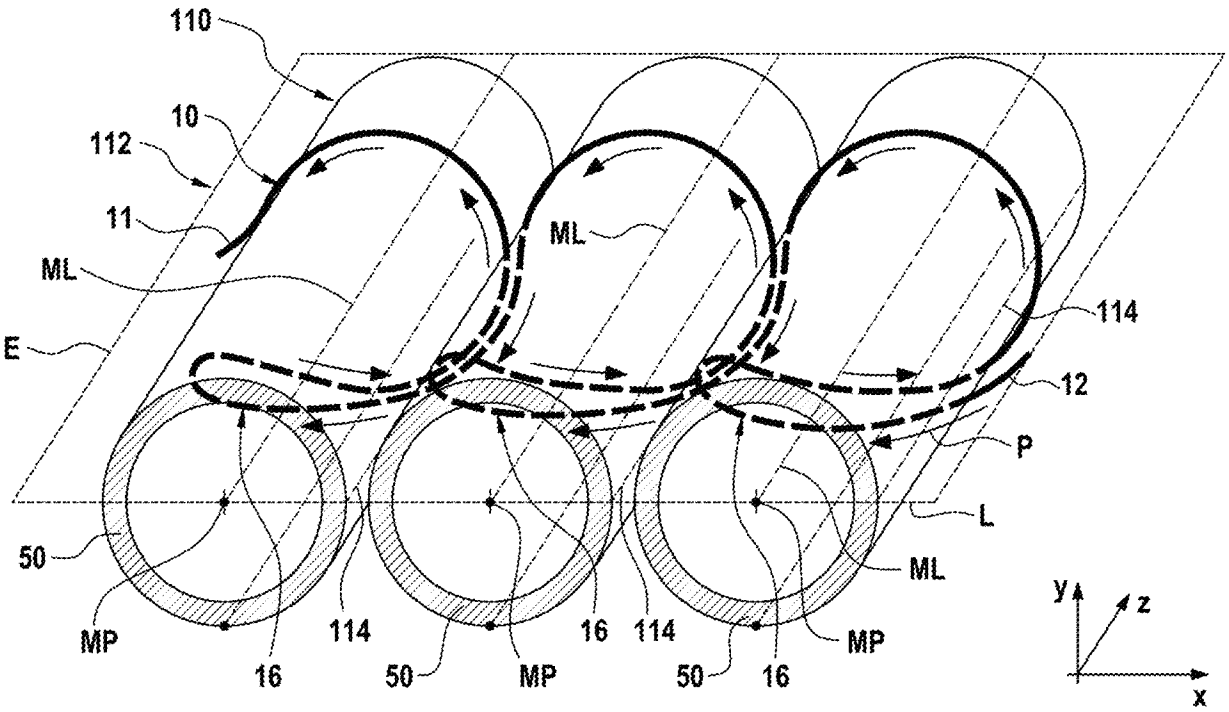
FIG. 3 is a perspective view of glass article portions of a glass article layer comprising three glass articles according to a first embodiment.

FIG. 3 is a perspective view of a glass article layer 110 comprising only three glass articles 50, in order to explain the arrangement of a thread-like element 10. Shown are only the portions of the glass articles 50 where a spacer position 112 is located, by way of example.

For the sake of better understanding, the spacing between the glass articles 50 is shown significantly enlarged and the thread-like element 10 is indicated by arrows P to illustrate the running direction of the thread-like element 10, which will be explained in more detail in conjunction with the method for producing the glass article layer 110 (see FIGS. 16 to 19).

Figure 4:
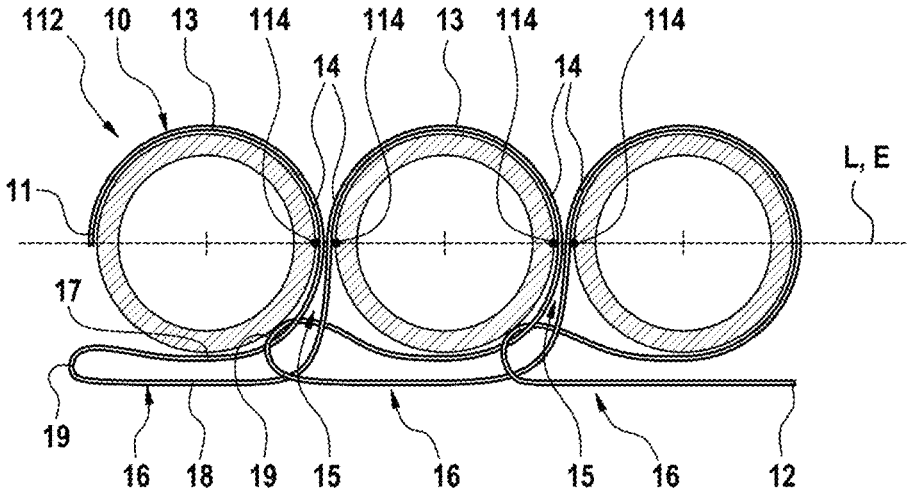
FIG. 4 is an elevational view showing the end face of the arrangement of FIG. 3.

FIG. 4 is an elevational view of the portion of a glass article layer 110 shown in FIG. 3.

A single thread-like element 10 having ends 11 and 12 is wrapped around all three glass articles 50, while the thread-like element 10 does not necessarily engages everywhere on the outer surface of the glass article 50. Whether the thread-like element 10 engages on the outer surface of the glass article 50 depends on the selected thread tension of the thread-like element 10 during the production process of the glass article layer 110. Moreover, the spacing between the adjacent glass articles 50 can be adjusted through the thread tension.

In FIG. 3, the centers MP of glass articles 50 are indicated, which lie on a line L. The center lines ML of the glass articles 50 lie in a common plane E which intersects the outer surfaces of the glass articles 50 along the so-called contact line 114. The juxtaposed glass articles 50 would contact along this contact line 114, if no spacers were provided.

The thread-like element 10 is wrapped around the upper outer circumference of each glass article 50 and forms a wrap 13 there, which in the region of the contact line 114 transitions into the thread section 14 that provides the spacer between the glass articles 50. In the embodiment shown here, each thread section 14 is wrapped around 10% of the outer circumference of the glass article 50. Between the spacers, each thread-like element 10 forms a loop 16 which is located below the respective glass articles 50 and has first and second loop sections 17 and 18. The two loop sections 17 and 18 are interconnected by a third loop section 19 which is substantially accommodated in a lower wedge-shaped interspace 15.

Two of the three loops 16 are interlooped with a respective neighboring loop 16. To this end, loop sections 17 and 18 of one loop 16 are passed through the neighboring loop 16. It is also possible for the thread-like element 10 to be arranged such that the loops 16 rest on the upper side of the glass articles 50.

While the thread sections 14 define the spacers between adjacent glass articles 50, the loops 16, in particular loop sections 17 and 18, are provided as spacers between the glass articles 50 of two glass article layers 110 stacked on top of each other in the y-direction.

Figure 5:
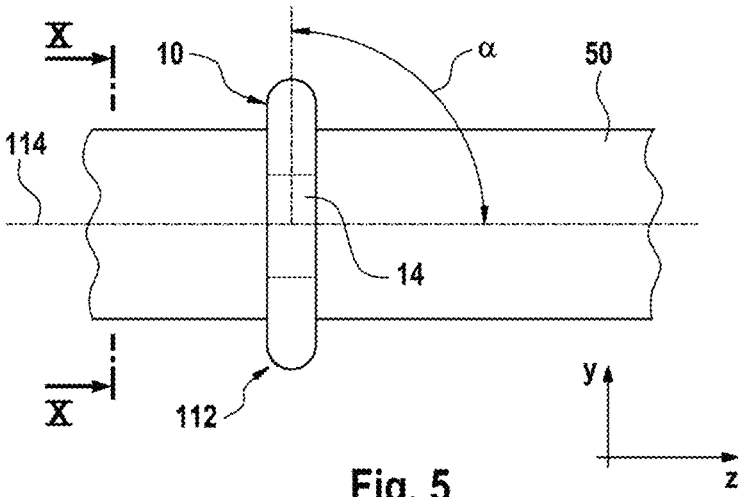
FIG. 5 is a side view of a portion of a glass article.

FIG. 5 shows a side view of a glass article portion with a thread-like element 10, where the thread section 14 forms an angle $\alpha$ of 90° with the z-axis and thus with the contact line 114.

Figure 6:
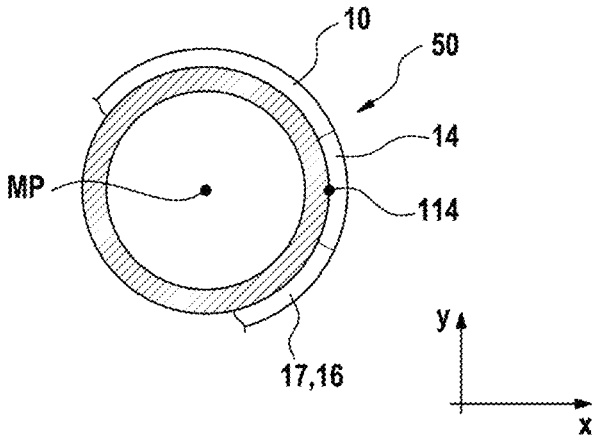
FIG. 6 is a cross-sectional view through the glass article of FIG. 5 along the line X-X.

FIG. 6 is a cross-sectional view through the glass article 50 along the line X-X in FIG. 5 to illustrate the thread section 14 that is effective as a spacer. The ten-percent overlapping with the outer circumference of glass article 50 mentioned in conjunction with FIG. 4 means that the thread section 14 extends over approximately 5% of the outer circumference of the glass article 50 on both sides of the contact line 114. When adjacent glass articles 50 slip in the y-direction, thread section 14 always prevents the surfaces of the adjacent glass articles 50 from contacting each other.

Figure 7:
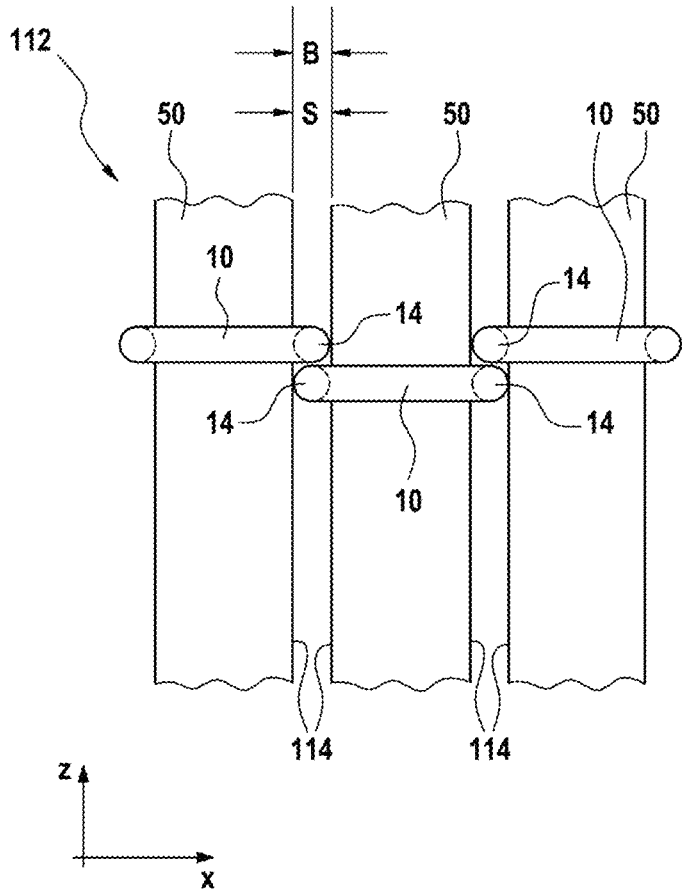
FIG. 7 is a plan view of a section of the glass article layer according to FIG. 3.

FIG. 7 is a plan view of the glass article layer 110 of FIG. 3, showing that the spacing B between adjacent glass articles 50 corresponds to the thread thickness S of thread sections 14.

Figure 8:
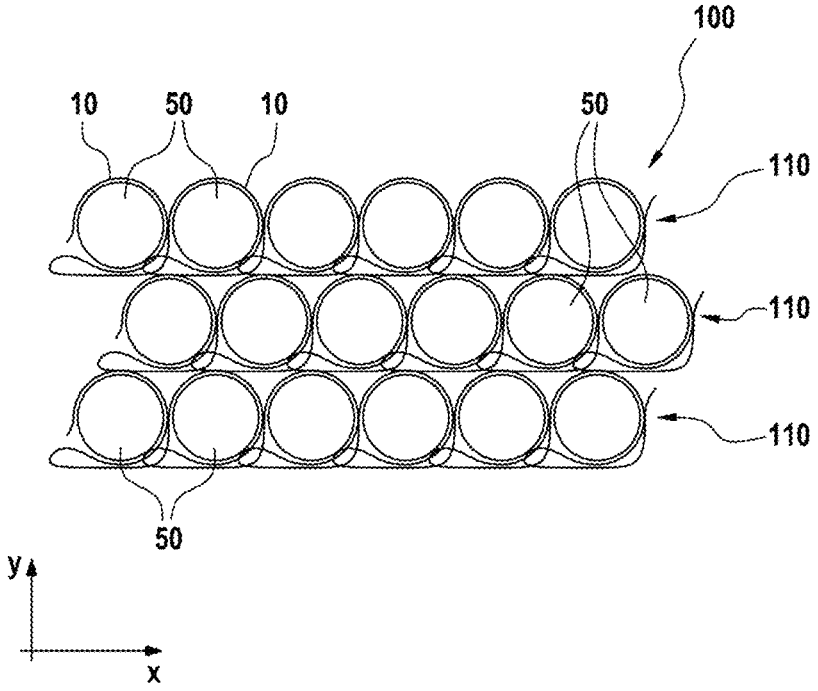
FIG. 8 is an end view of a glass article bundle comprising glass article layers according to FIGS. 3 to 7.

FIG. 8 is an elevational view showing the end face of a glass article bundle 100 which comprises three glass article layers 110 according to FIGS. 3 to 7. The glass article layers 110 are arranged offset to one another, so that when the glass article layers 110 have reached their final position, close-packing of the glass articles 50 is achieved. In the view of FIG. 3, the glass article layers 110 have not yet reached their final position, for a better illustration of the course of the threads. It can be seen that the loops 16 form spacers between superposed glass articles 50.

Figure 9:
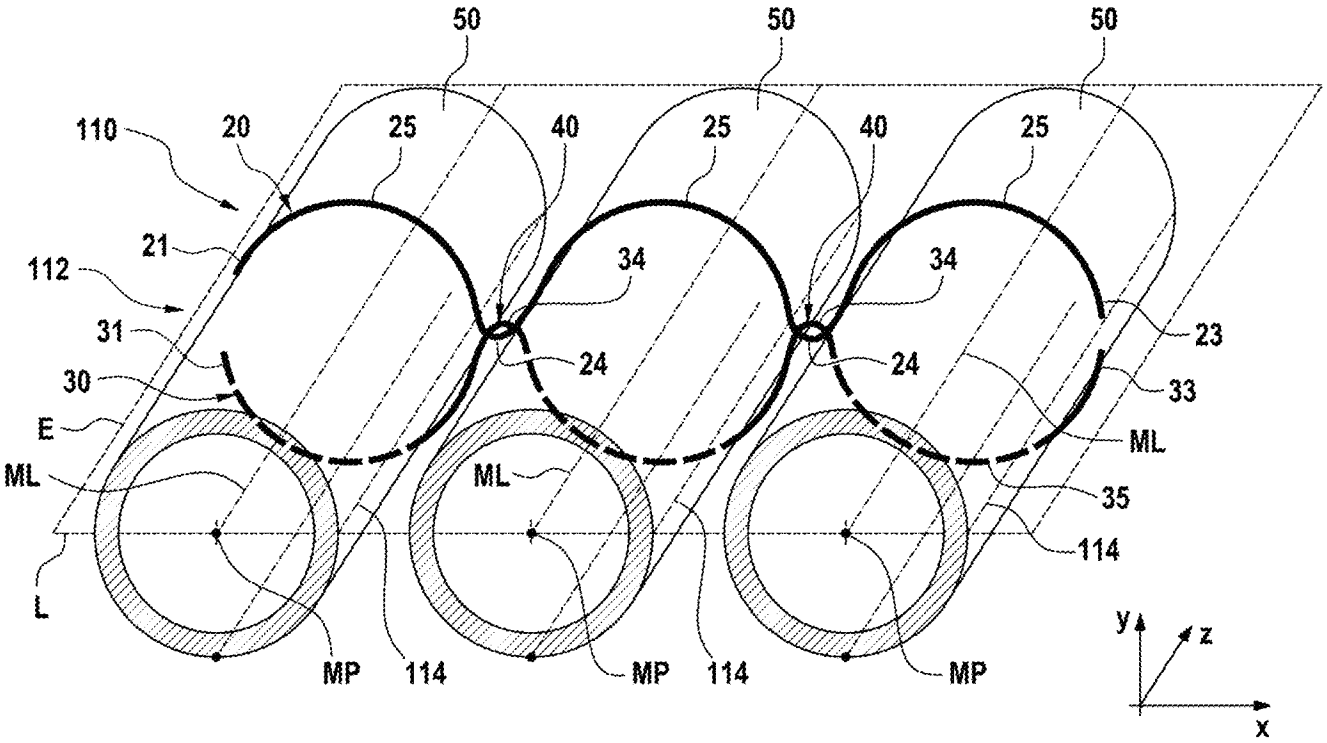
FIG. 9 is a perspective view of glass articles portions of a glass article layer according to a second embodiment.

FIG. 9 shows portions of three glass articles 50 which form a glass article layer 110 according to a second embodiment.

Figure 10:
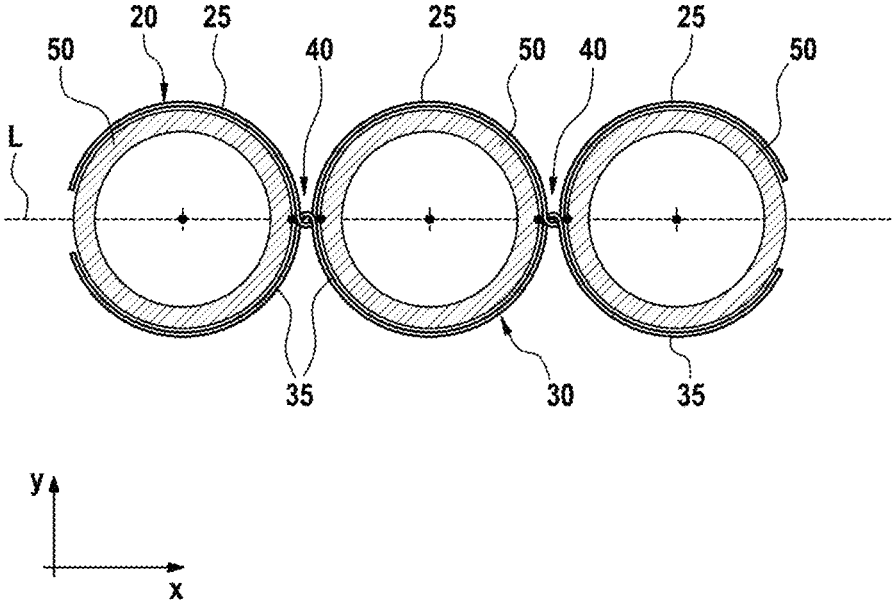
FIG. 10 is an elevational view showing the end face of the glass article layer of FIG. 9.

As in FIG. 3, the center points MP, center lines ML, line L, plane E, and contact lines 114 are indicated in FIG. 9. FIG. 10 shows an end view of the section of a glass article layer 110 shown in FIG. 9.

In this embodiment, two thread-like elements 20, 30 are provided at each spacer position 112. The first thread-like element 20 which may also be referred to as an upper thread 20 is wrapped around the upper half of the outer circumference of the glass article 50 and forms an upper wrap 25, while the second thread-like element 30 which may also be referred to as a lower thread 30 is wrapped around the lower half of the outer circumference of the glass article 50 and forms a lower wrap 35.

The ends 21, 23 of the upper thread 20 are connected to the ends 31, 33 of the lower thread 30, for example by fusing or gluing.

Between the upper wraps 25, thread sections 24 are provided defining the spacers. Between the lower wraps 35, thread sections 34 are provided defining the spacers. Each thread section 24, 34 engages both on the outer circumference of one glass article 50 and on the outer circumference of the adjacent glass article 50. Thread sections 24, 34 are bights 27 which are entangled to form an interlace 40. Thread sections 24, 34 with the interlaces 40 define the spacers and are located in the region of the contact line 114.

Figure 11:
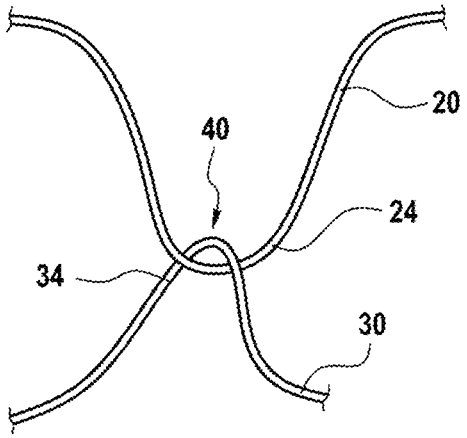
FIG. 11 is a schematic illustration of an interlace.

Interlace 40 is shown enlarged in FIG. 11.

Figure 12:
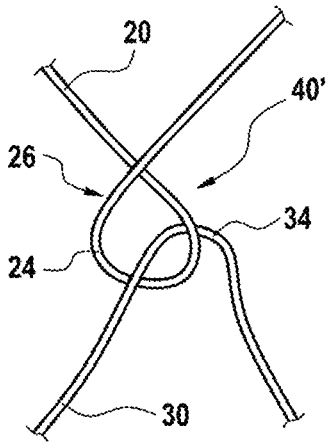
FIG. 12 is a schematic illustration of a knotted interlace.

FIG. 12 illustrates a modification of the interlace 40, which is referred to as a knotted interlace 40'. Thread section 24 is in the form of a turn with lengths of the thread section 24 crossing each other. The bight 27 of thread section 34 extends through this turn 26, and when the turn 26 is tightened the thread section 34 will be fixed in the turn 26.

Figure 13:
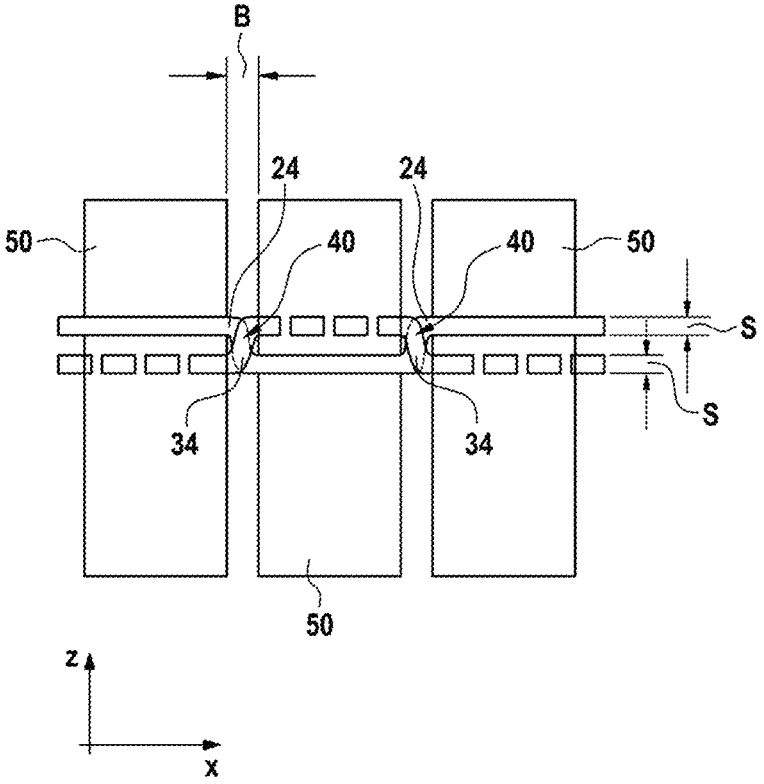
FIG. 13 is a plan view of the arrangement of glass articles of a glass article layer as shown in FIG. 9.

FIG. 13 is a schematic plan view of the glass article layer 110 of FIG. 9 showing that the spacing B between adjacent glass articles 50 may be greater than the thread thickness S of thread sections 24, 34, because of the interlace 40.

Figure 14:
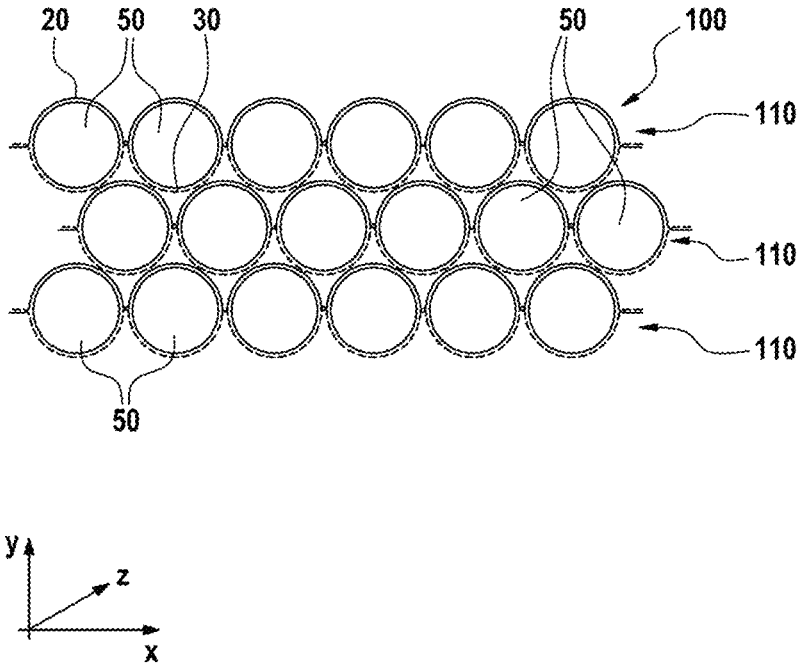
FIG. 14 is an elevational view showing the end face of a glass article bundle comprising glass article layers according to FIGS. 9 to 13.

FIG. 14 shows the end face of a glass article bundle 100 which comprises three glass article layers 110 stacked on top of each other in the y-direction in accordance with FIG. 9. The glass article layers 110 are arranged offset to one another, so that a close-packing is achieved.

Figure 15:
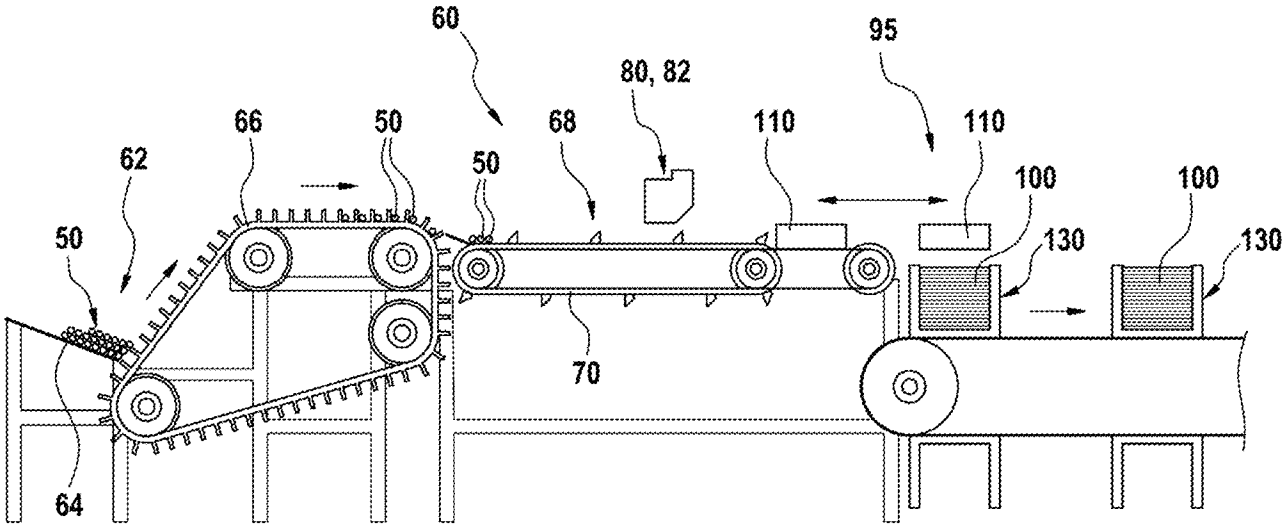
FIG. 15 is a schematic view of a packing system for producing glass article layers and glass article bundles.

FIG. 15 schematically shows a packing system 60 for producing glass article layers 110 and glass article bundles 100. The glass articles 50 are provided on an inclined plane 64 and taken over by a first conveyor belt 66 in a feed station 62. The individual glass articles 50 are transferred to a second conveyor belt 70 and fed into a separation station 68.

Conveyor belt 70 feeds the separated glass articles 50 to a packing station 80 which comprises at least two wrapping stations 82. The wrapping stations 82 are arranged next to each other at an interval A which corresponds to the distance between the spacer positions 112 of the glass article layer 110, so that the wrapping operation can be carried out at the spacer positions 112 of the glass article layer 110. The second conveyor belt 70 consists of a plurality of juxtaposed and synchronously operated individual belts 71, the number of which depends on the number of wrapping stations 82.

Preferably, three individual belts 71 are provided in the case of two wrapping stations 82, which are spaced from each other. The spacing between the individual belts 71 is required for passing the needles 84 of the wrapping stations 82.

After the thread-like elements 10, 20, 30 have been severed, the completed glass article layer 110 is then transferred to a container 130, in a transfer station 95, where the individual glass article layers 110 are stacked on top of each other in close-packing. Thus, there is a glass article bundle 100 in the container 130, which is taken away and provided with a cover sheath 120 made of a shrink film at the ends 102, 104 thereof, in an enveloping station (not shown).

Figure 16:
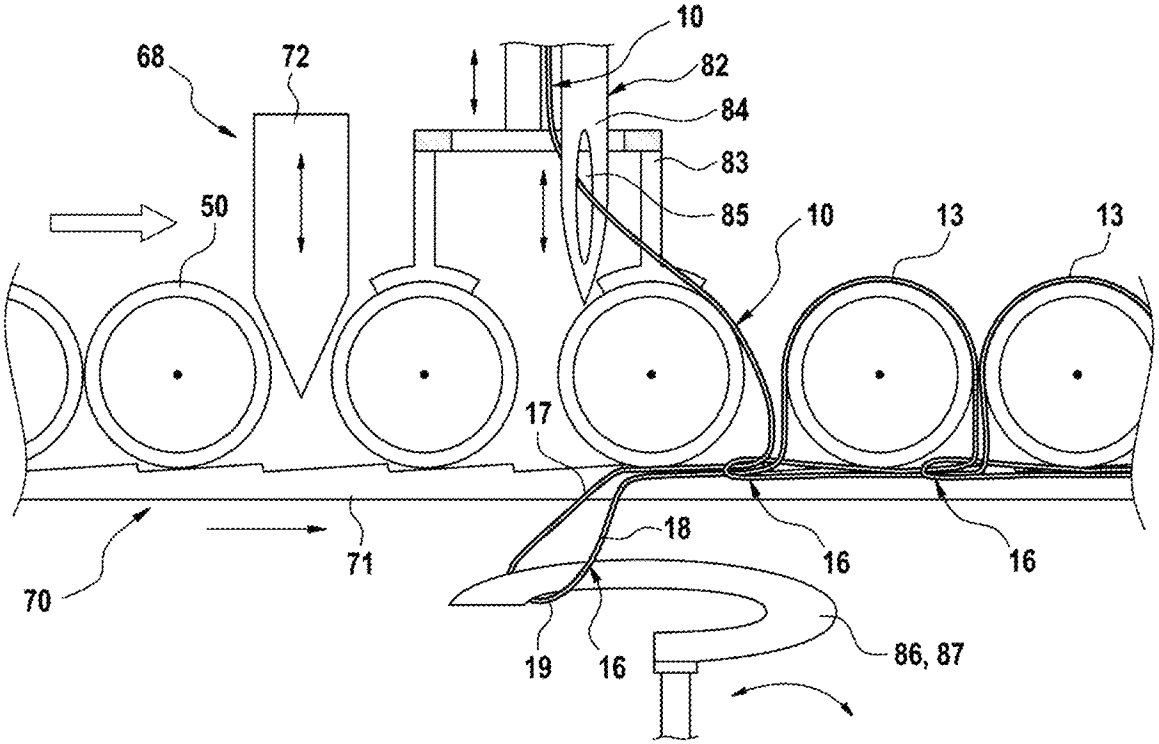
FIGS. 16-19 show several method steps of a wrapping procedure according to a first embodiment.

By way of example, FIG. 16 shows a side view of such a wrapping station 82 according to a first embodiment, with an upstream separation station 68. In this separation station 68, a separating tool 72 is provided which is wedge-shaped and is introduced in the vertical direction between the glass articles 50 arriving on the second conveyor belt 70 in order to separate the glass articles 50. Subsequently, the separated glass article 50 is fixed on the second conveyor belt 70 by a downholder 83 and a thread-like element 10 is wrapped around it in the wrapping station 82, which thread-like element 10 is fed from above into an eyelet 85 of a needle 84. FIG. 16 shows an individual belt 71 of the second conveyor belt 70 in a side view.

The needle 84 is located above the second conveyor belt 70 and is moved in the vertical direction. Needle 84 cooperates with a thread looper 86 which is disposed below the second conveyor belt 70. Thread looper 86 is a loop-taker 87 which grasps the loop 16 of the thread-like element 10 extending through the gap between two adjacent individual belts 71 of the second conveyor belt. The needle 84 passes the thread-like element 10 through the provided loop 16.

Figure 17:
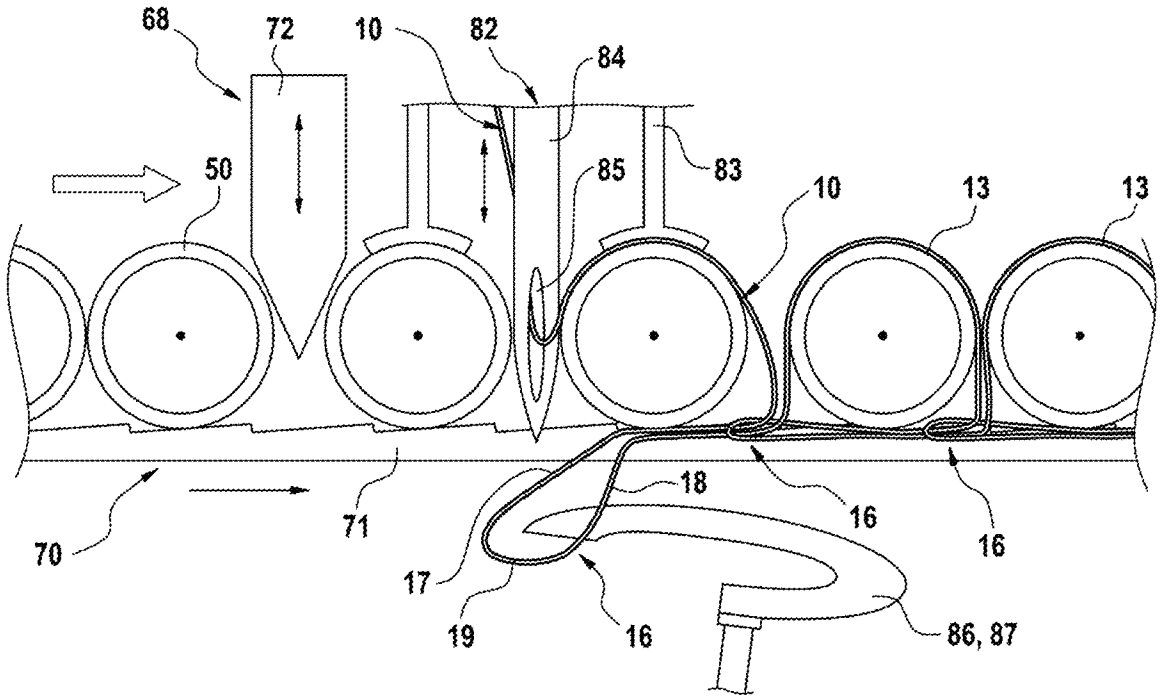
Figure 18:
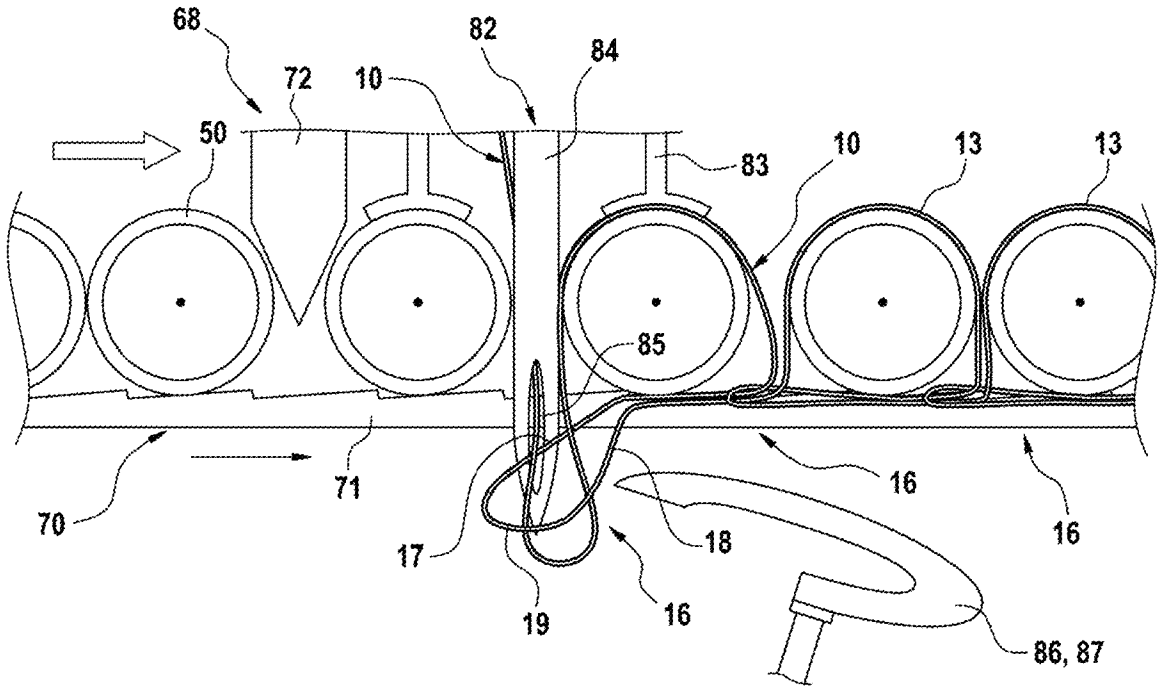
Figure 19:
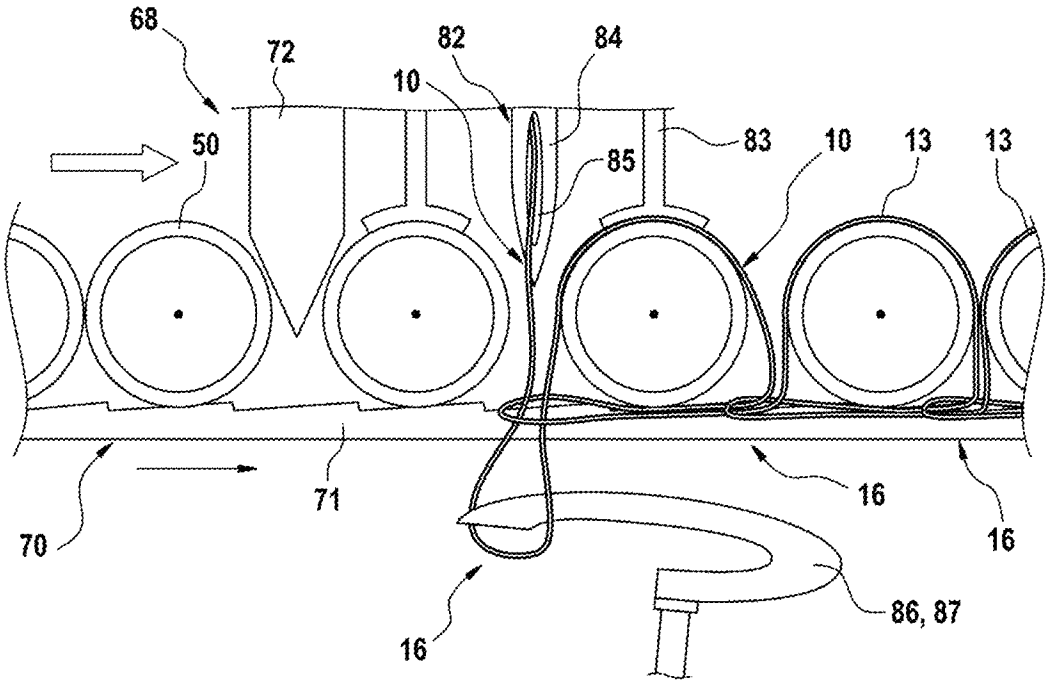

The individual steps of the wrapping process are illustrated in more detail in FIGS. 17 to 19. The procedure involves a needle 84 reciprocating up and down, and a loop-taker 87 reciprocating back and forth.

The wrapping technique is comparable to the single-thread chain-stitch technique known from sewing machines.

In FIG. 17, the needle 84 is further lowered and the loop-taker 87 releases the loop 16, while the needle 84 retains the loop 16 thereby expanding it until the needle 84 is able to enter into the open loop 16, as seen in FIG. 18. Thereafter, the loop-taker 87 is withdrawn and releases the loop 16. When the needle 84 is subsequently pulled up, the loop-taker 87 grasps the new loop 16 which extends though and is interlooped with the preceding loop 16. Thereafter, the process starts from the beginning to wrap the subsequent glass article 50.

Figure 20:
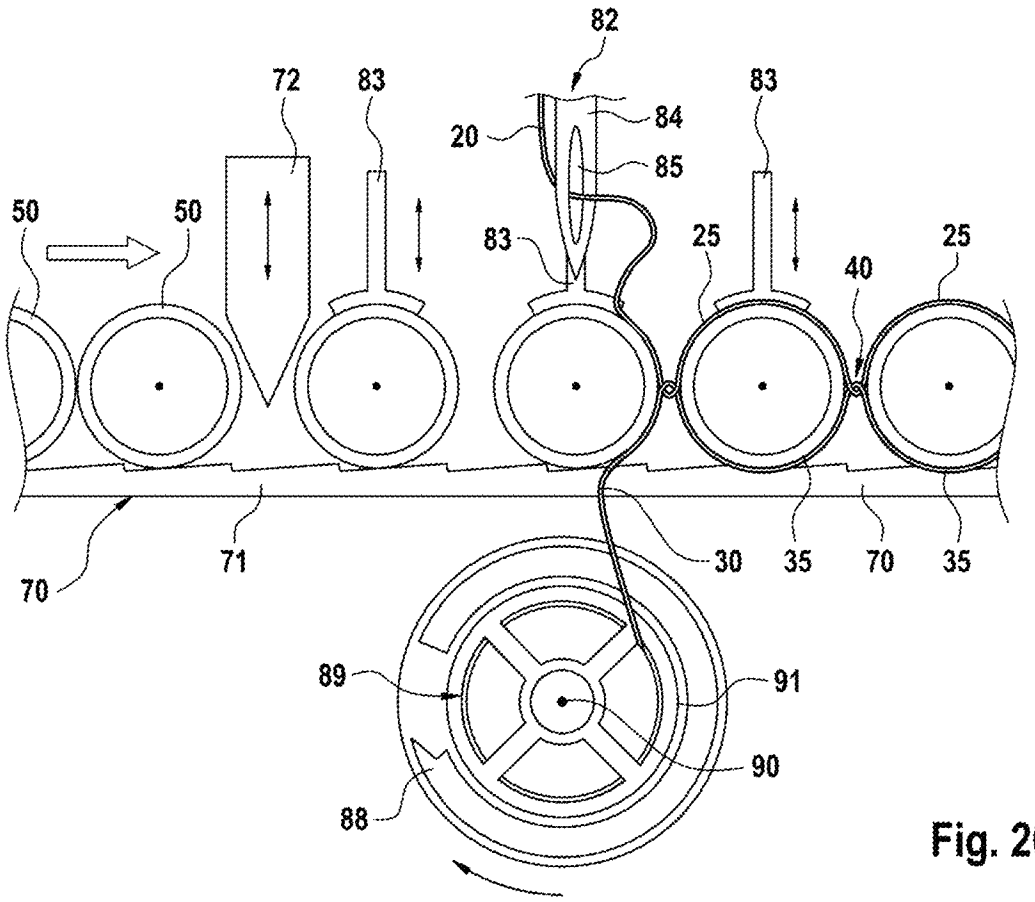
FIGS. 20-25 show several method steps of a wrapping procedure according to a second embodiment.

FIG. 20 shows a side view of a wrapping station 82 according to a second embodiment, by way of example, with an upstream separation station 68. In this separation station 68, a separating tool 72 is provided, which is wedge-shaped and is introduced in the vertical direction between the glass articles 50 arriving on the second conveyor belt 70 in order to separate the glass articles 50. Subsequently, the separated glass article 50 is fixed on the second conveyor belt 70 by a downholder 83 and a thread-like element 20 (upper thread) and a second thread-like element 30 (lower thread) are wrapped around it in the wrapping station 82.

The upper thread 20 is introduced from above into an eyelet 85 of a needle 84 which is provided above the second conveyor belt 70. The lower thread 30 is wound on a bobbin 89 and is introduced to the glass articles 50 from below, through a gap between adjacent individual belts 71 of the second conveyor belt 70.

As in the previous embodiment, the second conveyor belt 70 consists of two or more synchronously driven strap belts arranged along the advancement direction and defining the individual belts 71. These individual belts 71 are positioned in such a manner along the axis of the glass article 50 that the needles 84 can be positioned in the free spacings and are not hindered by the individual belts 71.

The bobbin 89 is accommodated in a bobbin case 91 which is surrounded by an annular thread looper 86 that is also referred to as a rotary hook 88. The bobbin 89 and the rotary hook 88 rotate together about a horizontal axis 90 in the direction of the arrow.

Figure 21:
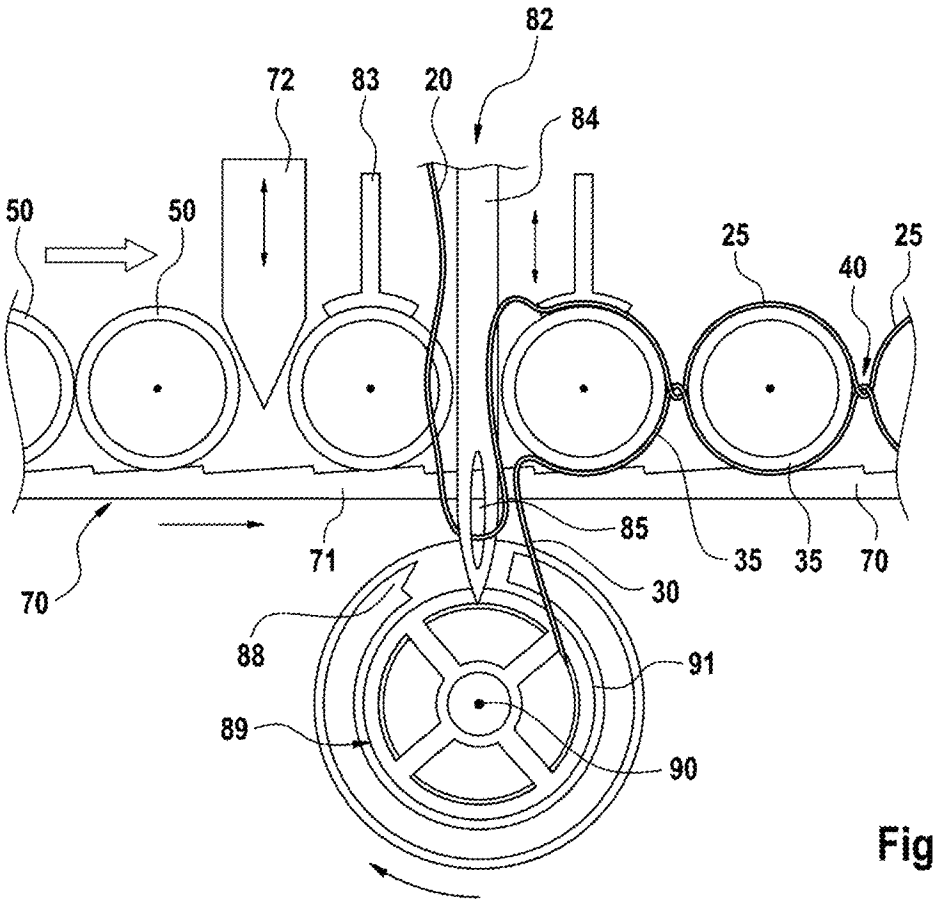
Figure 22:
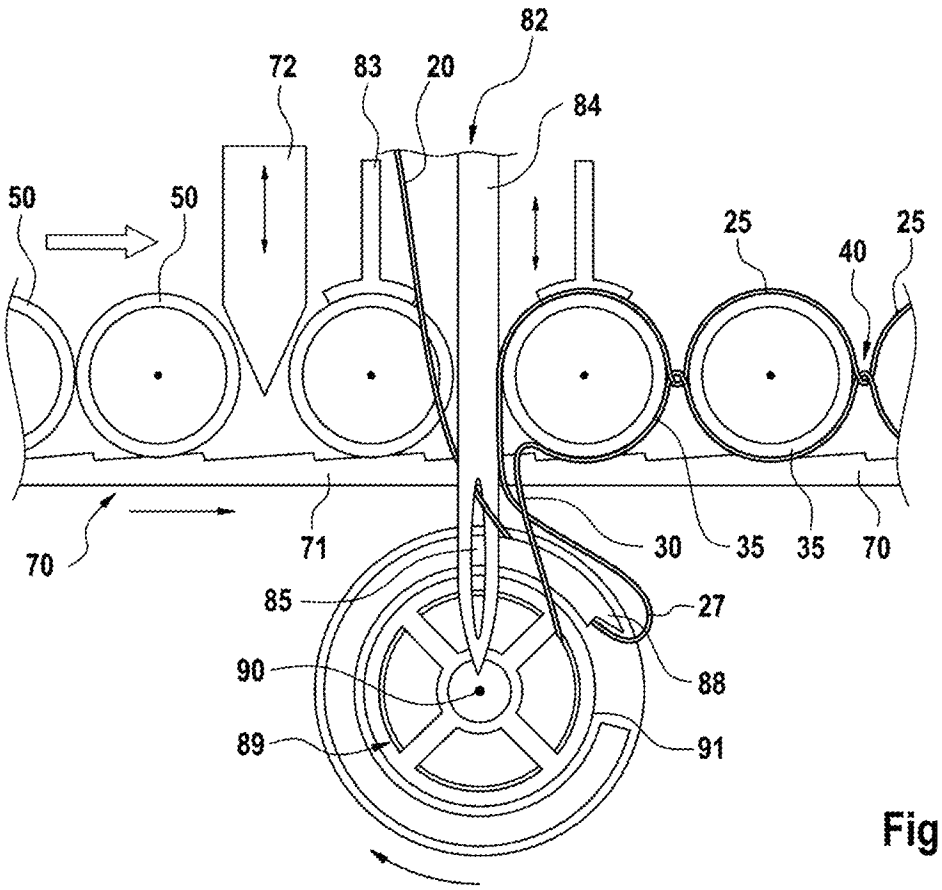
Figure 23:
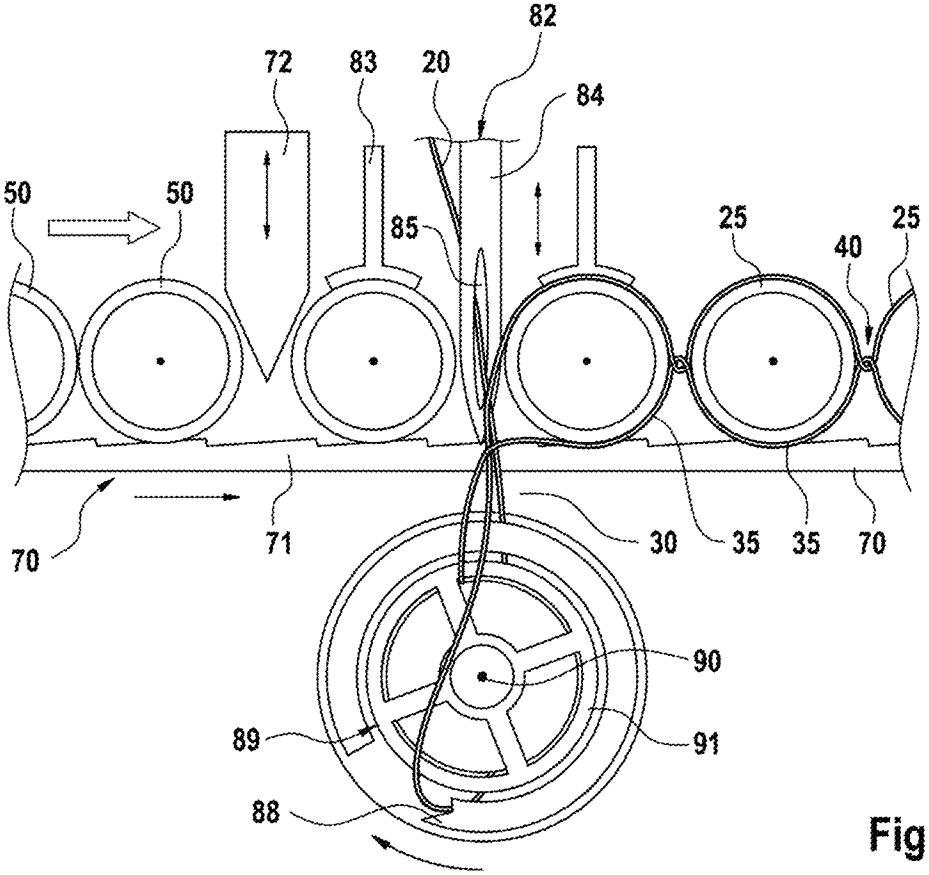
Figure 24:
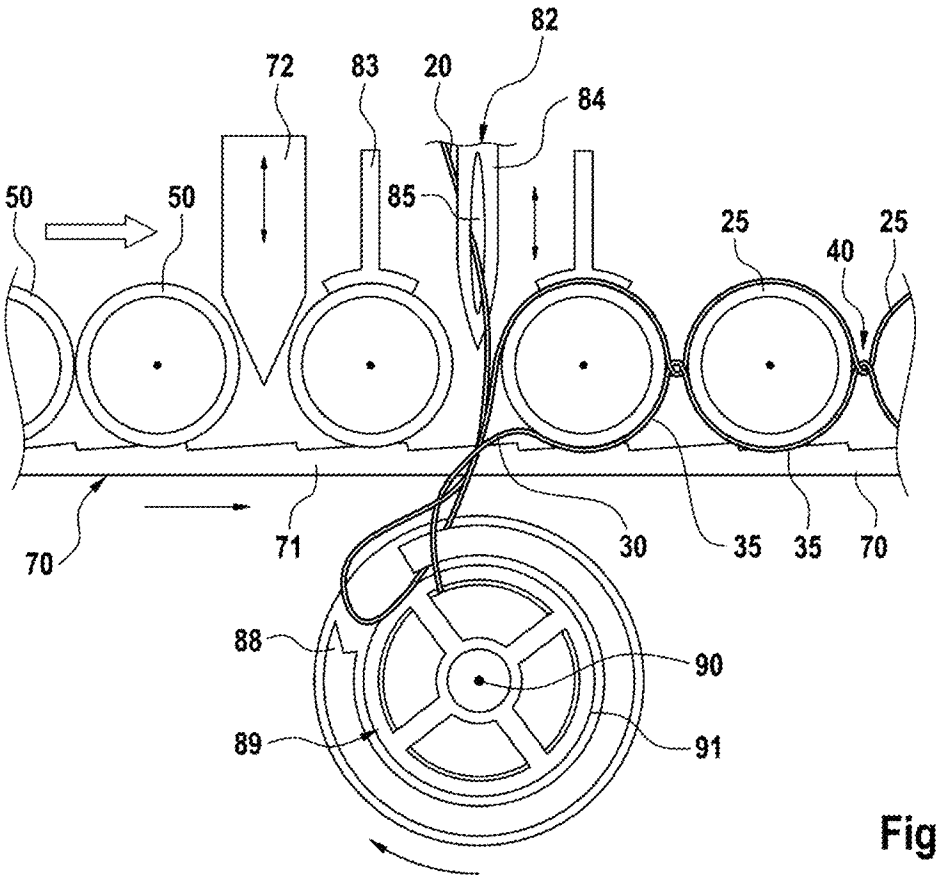
Figure 25:
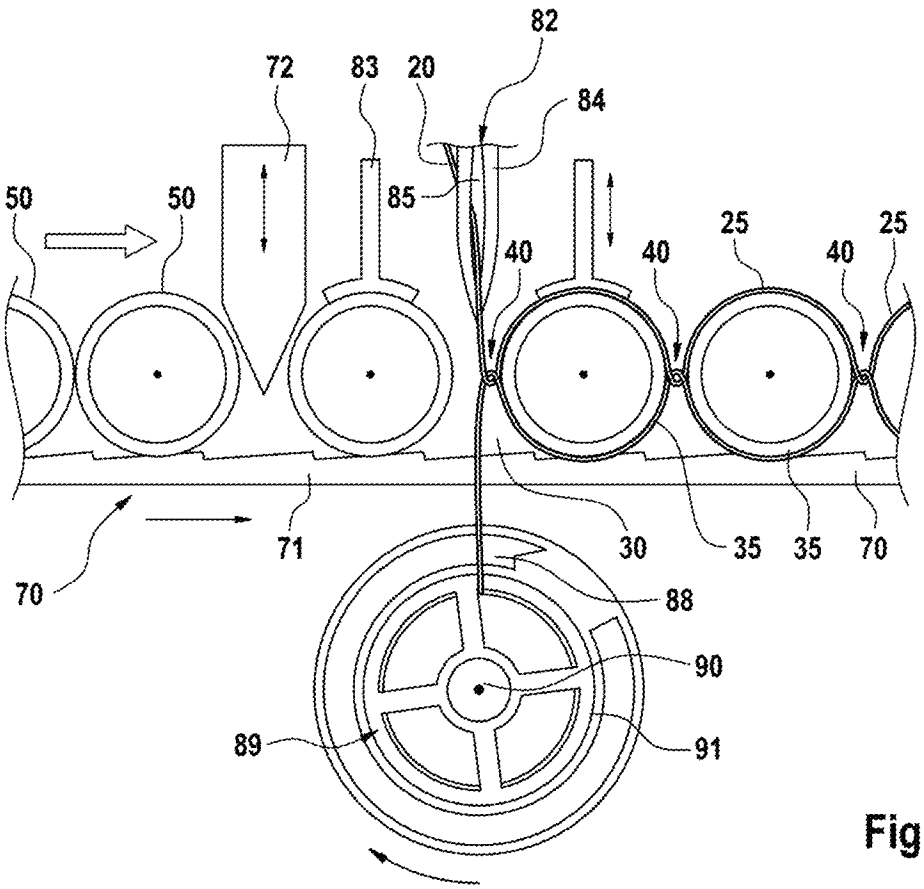

The needle 84 is moved down into the vicinity of the bobbin 89, whereby the upper thread 20 forms a loop 27 which is grasped by the rotary hook 88 (see FIGS. 21, 22). During the continued rotation of the rotary hook 88, the upper thread 20 is pulled around the bobbin 89 and the needle 84 is pulled upwards, while the lower thread 30 is simultaneously introduced into the loop 27 of the upper thread 20 (see FIG. 23). Then, the loop 27 of the upper thread 20 is released from the rotary hook 88 (see FIG. 24). In this way, the interlace 40 is formed (see FIG. 25). Thereafter, the process starts from the beginning to wrap the subsequent glass article 50.

Figure 26:
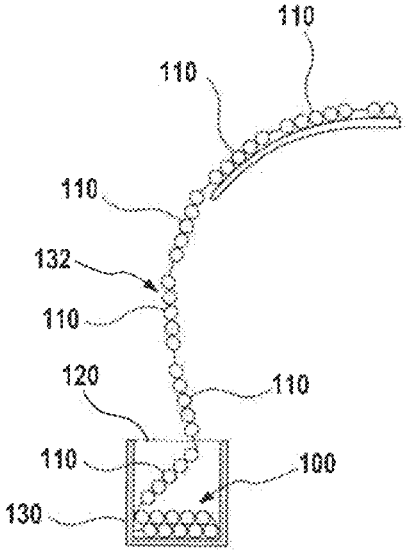
FIG. 26 is an illustration for explaining the producing of a glass article bundle.

FIG. 26 shows the producing of a glass article bundle 100. Once the wrapping process has been completed, the individual glass article layers 110 are not separated from one another as has been explained in conjunction with FIG. 15. A layer ribbon 132 consisting of glass article layers 110 is fed into a U-shaped container 130 where the layer ribbon 132 is folded down such that the individual glass article layers 110 come to rest on top of each other in close-packing. When the container 130 is filled so that a bundle 100 of glass articles is completed, the layer ribbon 132 is severed between two glass article layers 110. The glass article bundle 100 is provided with a cover sheath 120 from both ends thereof and is then removed from the container 130.

LIST OF REFERENCE CHARACTERS

10 Thread, thread-like element
11 First end
12 Second end
13 Wrap
14 Thread section
15 Wedge-shaped interspace
16 Loop
17 First loop section
18 Second loop section
19 Third loop section
20 First thread-like element, upper thread
21 First end
23 Second end
24 Thread section
25 Upper wrap
26 Turn
27 Bight
30 Second thread-like element, lower thread
31 First end
33 Second end
34 Thread section
35 Lower wrap
40 Interlace
40' Knotted interlace
50 Glass article
60 Packing system
62 Feed station
64 Inclined plane
66 First conveyor belt
68 Separation station
70 Second conveyor belt
71 Individual belt
72 Separating tool
80 Packing station
82 Wrapping station
83 Downholder
84 Needle
85 Eyelet
86 Thread looper
87 Loop-taker
88 Rotary hook
89 Bobbin
90 Horizontal axis
91 Bobbin case
95 Transfer station
100 Glass article bundle
102 End of glass article bundle
104 End of glass article bundle
110 Glass article layer
112 Spacer position
114 Contact line
120 Cover sheath
130 Container
132 Layer ribbon consisting of glass article layers
A, A1, A2 Interval of spacer positions
L Line extending through the centers of the glass articles
S Thread thickness
e Plane
P Arrow for advancement direction
ML Center line
MP Center

What is claimed is:

1. A glass article layer comprising:

two glass articles extending in a z-direction and arranged side by side in an x-direction;

two spacer positions are provided spaced apart at an interval A in the z-direction longitudinally of the two glass articles; and spacers are arranged between the two glass articles, wherein the spacers are thread-like elements, wherein at least one of the thread-like elements is provided at each of the two spacer positions, wherein only one of the thread-like elements is provided at each of the two spacer positions, and wherein the only one of the thread-like elements includes a loop in a y-direction below or above the two glass articles.

2. The glass article layer of claim 1, wherein the thread-like element is at least partially wrapped around every glass article at the two spacer positions.

3. The glass article layer of claim 1, wherein each of the thread-like elements has two thread sections interposed between the two glass articles at each of the two spacer positions.

4. The glass article layer of claim 1, wherein the glass articles are glass tubes or glass rods.

5. The glass article layer of claim 1, wherein each of the thread-like elements has a thread thickness S where 0.25 mm≤S≤2.5 mm.

6. The glass article layer of claim 1, wherein each of the thread-like elements is made of a plastic material.

7. The glass article layer of claim 6, wherein the plastic material is selected from a group consisting of polypropylene (PP), polyethylene (PE), high-density polyethylene (HDPE), polyethylene wax, polyamide (PA), styrene-acrylonitrile copolymer (SAN), polyester, polyethylene terephthalate (PET), polybutylene terephthalate (PBT), polyurethane (PU), acrylonitrile-butadiene-styrene copolymer (ABS), polyether ether ketone (PEEK), and polycarbonate (PC).

8. The glass article layer of claim 1, wherein the two spacer positions are provided at intervals between 20 cm and 80 cm.

9. The glass article layer of claim 1, wherein the only one of the thread-like elements has two thread sections interposed between the two glass articles at each of the two spacer positions.

10. The glass article layer of claim 9, wherein the two thread sections extend at an angle $\alpha$ relative to the z-direction, with $80° \leq \alpha \leq 100°$.

11. The glass article layer of claim 9, wherein each thread section of the two thread sections is wrapped around at least 5% of the outer circumference of one of the two glass articles.

12. The glass article layer of claim 9, wherein each thread section of the two thread sections is juxtaposed in the z-direction.

13. The glass article layer of claim 1, wherein the only one of the thread-like elements is wrapped around at least 70% of the outer circumference of the two glass articles.

14. The glass article layer of claim 1, wherein two thread-like elements is provided at each of the two spacer positions, the two-thread like elements comprising a first thread-like element and a second thread-like element.

15. The glass article layer of claim 14, wherein the first thread-like element has one thread section and the second thread-like element has another thread section.

16. The glass article layer of claim 15, wherein the thread section of the first and second thread-like elements form an interlace between the two glass articles.

17. The glass article layer of claim 15, wherein the thread section of the first and second thread-like elements form a knotted interlace between the two glass articles.

18. The glass article layer of claim 14, wherein the first thread-like element is wrapped around an upper half of an outer circumference of two glass articles and the second thread-like element is wrapped around a lower half of the outer circumference.

19. A glass article bundle comprising two glass article layers as claimed in claim 1, the two glass article layers being arranged on top of each other in a y-direction, wherein the two glass article layers are arranged offset one above the other.

20. The glass article bundle of claim 19, wherein the thread-like elements of the glass article layers are spacers between the two glass article layers.

21. The glass article bundle of claim 19, further comprising a cover sheath at least at both ends.

22. The glass article bundle of claim 21, wherein the cover sheath is made of a shrink film.

* * * * *